US008468752B2

(12) United States Patent
Lin

(10) Patent No.: US 8,468,752 B2
(45) Date of Patent: Jun. 25, 2013

(54) PREFABRICATED STRUCTURAL PARTS FOR CREATING A SMALL STRUCTURE

(76) Inventor: Calvin Lin, Plano, TX (US)

( * ) Notice: Subject to any disclaimer, the term of this patent is extended or adjusted under 35 U.S.C. 154(b) by 196 days.

(21) Appl. No.: 13/186,694

(22) Filed: Jul. 20, 2011

(65) Prior Publication Data

US 2013/0019541 A1 Jan. 24, 2013

(51) Int. Cl.
*E04H 1/12* (2006.01)
*A63H 33/08* (2006.01)

(52) U.S. Cl.
USPC ..... 52/79.1; 52/586.1; 446/111

(58) Field of Classification Search
USPC ..... 52/262, 264, 285.1, 284, 586.1, 79.1, 52/604; 446/111, 112, 113, 122
See application file for complete search history.

(56) References Cited

U.S. PATENT DOCUMENTS

| | | | | | |
|---|---|---|---|---|---|
| 1,985,992 | A * | 1/1935 | Hayman | 446/122 |
| 2,150,707 | A * | 3/1939 | Anderson | 446/124 |
| 2,635,450 | A * | 4/1953 | Orzel | 52/582.1 |
| 2,708,329 | A * | 5/1955 | McKee | 52/286 |
| 2,787,028 | A * | 4/1957 | Webb | 52/198 |
| 2,849,832 | A * | 9/1958 | Jorgensen | 446/122 |
| 3,020,601 | A * | 2/1962 | Stambaugh et al. | 52/262 |
| 3,902,291 | A * | 9/1975 | Zucht | 52/284 |
| 4,212,130 | A * | 7/1980 | Walker | 446/111 |
| 4,257,207 | A * | 3/1981 | Davis | 52/578 |
| 5,222,902 | A * | 6/1993 | Piersch | 446/121 |
| 5,281,185 | A * | 1/1994 | Lee | 446/488 |
| 5,921,047 | A * | 7/1999 | Walker | 52/585.1 |
| 5,954,562 | A * | 9/1999 | Chen | 446/122 |
| 6,189,282 | B1 * | 2/2001 | VanderWerf | 52/582.1 |
| 6,250,022 | B1 * | 6/2001 | Paz et al. | 52/79.5 |
| 6,520,831 | B1 * | 2/2003 | Craig | 446/476 |
| 6,609,336 | B2 * | 8/2003 | Matsubara | 52/79.12 |
| 6,802,160 | B2 * | 10/2004 | Harambasic et al. | 52/264 |
| 7,104,221 | B2 * | 9/2006 | Simon | 119/498 |
| 7,241,198 | B1 * | 7/2007 | Boone | 446/476 |

FOREIGN PATENT DOCUMENTS

JP 04238954 A * 8/1992

* cited by examiner

*Primary Examiner* — Christine T Cajilig
(74) *Attorney, Agent, or Firm* — Szarzynski PLLC

(57) ABSTRACT

The preferred embodiment is a construction kit for small structures that can be built without tools and used as a shelter for animals, or an amusement device for people. In one embodiment, the kit includes two sizes of wall pieces and two sizes of corner pieces that connect to create a solid structure capable of withstanding the elements of nature. The wall and corner pieces have cavities that are arranged on the top, bottom and sides of the pieces. The pieces connect to each other using common connectors that fit snugly into the cavities. The pieces can be used to create a variety of differently sized and shaped structures. The preferred embodiment further comprises pieces that are used to create a roof structure and a floor structure that connect to the wall and corner pieces using connectors and said cavities. In the preferred embodiment the pieces are made of plastic using plastic-injection manufacturing processes. The pieces of a kit used to create a structure can be shipped and stored in a small volume relative to the size of the structure that can be created.

20 Claims, 18 Drawing Sheets

PREFABRICATED STRUCTURAL PARTS FOR CREATING A SMALL STRUCTURE

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

1. Field of the Invention

The present invention is in the technical field of prefabricated structural parts used to create small structures. Further, the present invention is in the technical field of construction kits for small modular buildings used to house animals, or used for children's playhouses.

2. Description of the Prior Art

The prior art describes many prefabricated structures. For example, U.S. Pat. Nos. 2,787,028, 3,020,601, 4,212,130, 5,222,902, 5,921,047, 6,520,831, 7,104,221, and 7,241,198 all describe prefabricated parts and construction methods used to create small structures that can be assembled without or with minimal use of tools. Similar to many solutions found in the prior art, the present invention is inexpensive to manufacture and ship, yet sturdy enough to meet the typical requirements of small structures, such as doghouses or playhouses. Further, like the present invention, many of the structures found in the prior art can be built and taken apart without tools.

Among other improvements, the present invention improves upon the prior art by providing prefabricated parts that can be used to create differently sized buildings. Thus, a small structure can be expanded into a larger structure when needed, such as when a puppy grows into an adult dog. Another improvement is due to the puzzle-piece-like properties of the structural components; the present invention may be used as an amusement device.

SUMMARY OF THE INVENTION

The present Invention comprises a limited number of structural members that can be configured to construct a variety of differently sized small buildings. The structural members share a symmetry, where all members can be described using the features of one member. The structural members primarily include wall panels and right-angle corner panels, where the corner panels are equivalent to two wall panels that intersect to create a right angle corner. A plurality of female connections exist on the sides of the wall and corner panels so that the panels can be joined together to create larger wall sections. The panels are joined together using a common connector pressed into female connections. The invention includes a feature where three panels share one connector. Embodiments further Include floor sections and roof sections.

DETAILED DESCRIPTION OF THE INVENTION

Figure 1A:
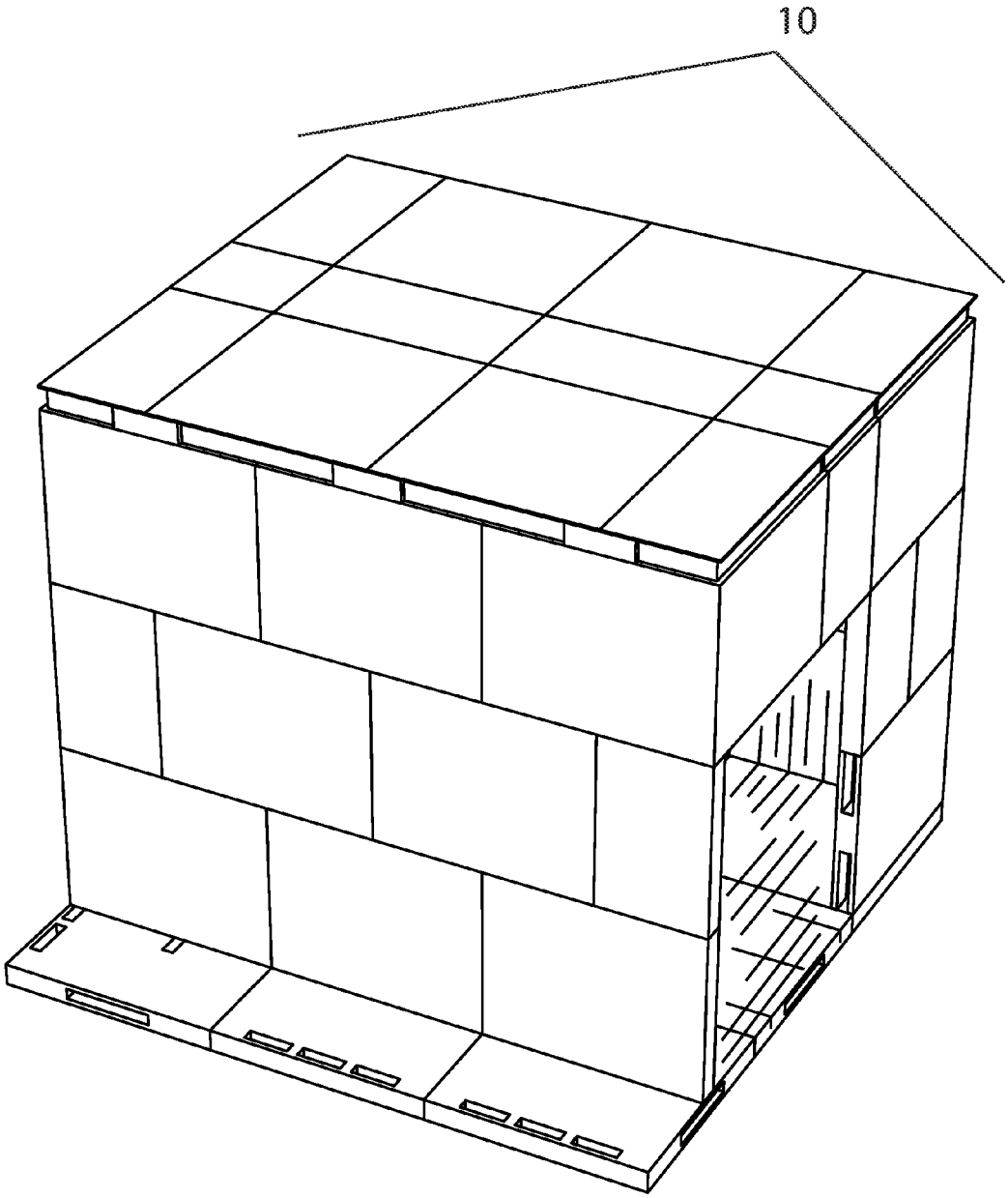
FIG. 1*a* is a perspective view of a structure.
Figure 1B:
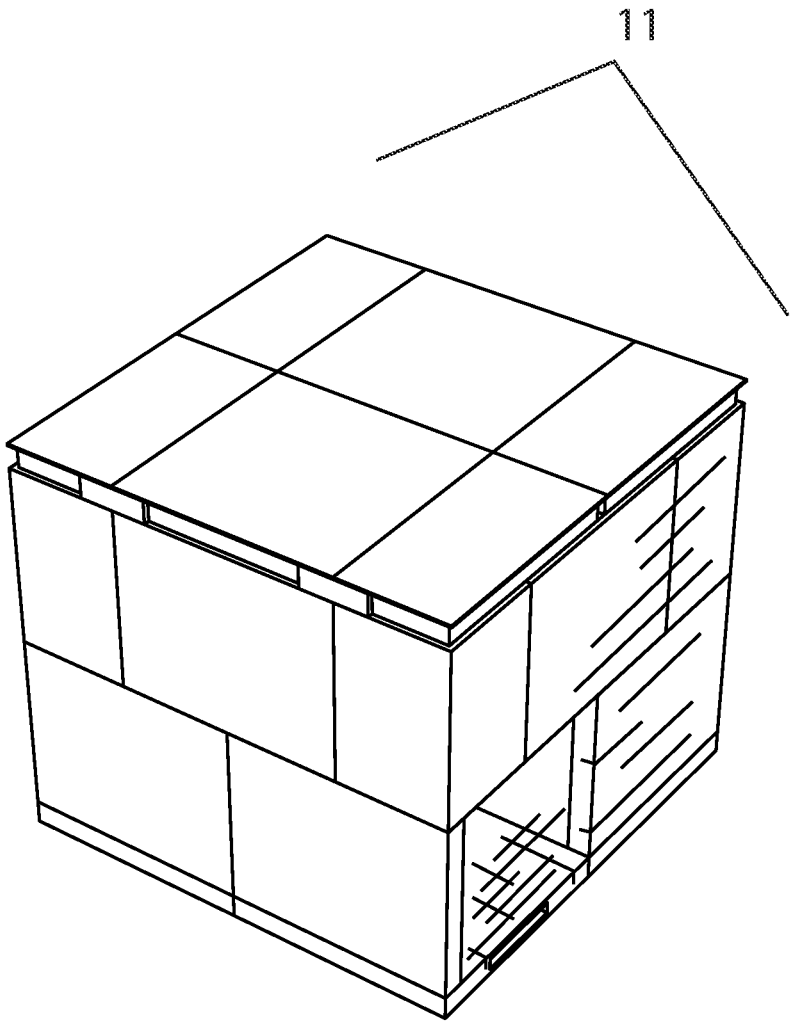
FIG. 1*b* is a perspective view of a structure.

Referring now to the drawings in detail, FIG. 1*a* shows Building 10, a structure that can be constructed using the structural members described herein. Building 10 is a small structure relative to houses built for humans; Building 10 is the size of atypical doghouse, or a child's playhouse. Building 10 has four walls, a floor, a roof, and an opening in one of the walls so that a child or small animal, such as a dog, can enter and exit the structure. The structure shown in FIG. 1*a* is but one of the many shapes of buildings that can be constructed using the structural members described in this document. For example, FIG. 1*b* shows a smaller structure that can be created using the prefabricated parts discussed herein.

Referring now to FIGS. 2 through 5, four wall pieces are shown. The wall pieces shown are rectangular pieces that have a front and back surface and four side surfaces. The four side surfaces are the smaller surfaces and can be defined as top, bottom, left and right. Arranged along the side surfaces are cavities that are evenly spaced. Cavity 15*s* are created by openings on the top and bottom surfaces that are positioned in the center of the top and bottom surfaces, where the center is defined as the middle between the front and back surface. The opening has a depth, creating Cavity 15. Cavity 15 has one opening, and can be described as a female connection, or a chamber. Edge Cavity 17 is equivalent to a Cavity 15 that is bisected by the adjacent surface. Thus, Edge Cavity 17 has an opening shared by two side surfaces adjacent to each other, such as a bottom surface and a left surface. The part of the Edge Cavity 17's opening that is on the top or bottom surface is half of the width of the Cavity 15's opening. The adjacent part of the Cavity 17's opening is equal to the depth of Cavity 15's depth. Thus, when two wall pieces are placed end to end with Edge Cavity 17*s* facing each other, the result is a cavity that is the same size as Cavity 15. Edge Cavity 17 is also referred to as a corner cavity, a bisected female connection, and a half-chamber.

Figure 2:
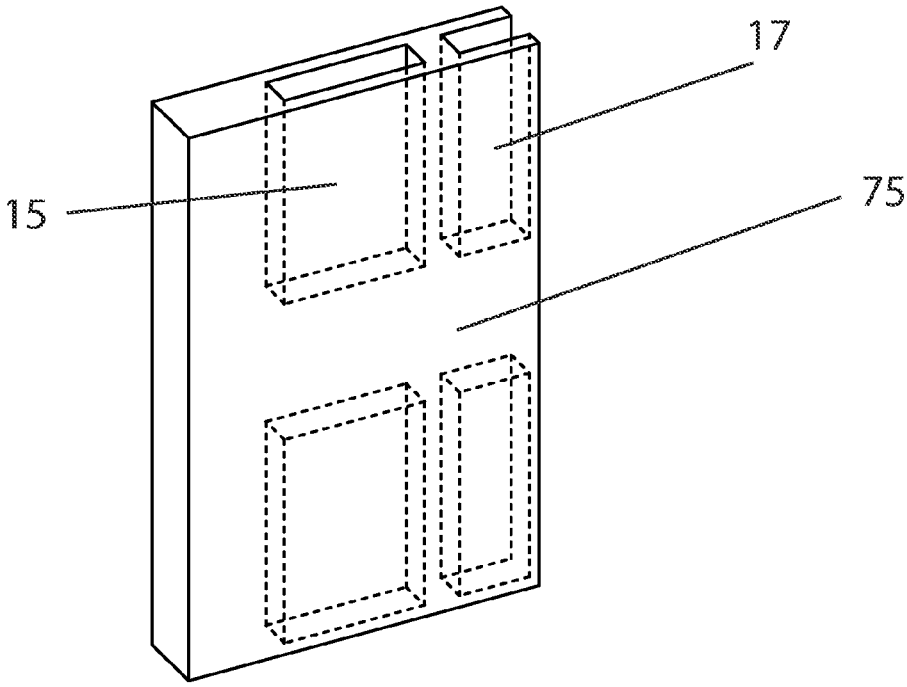
FIG. 2 is a perspective view of a wall part.
Figure 3:
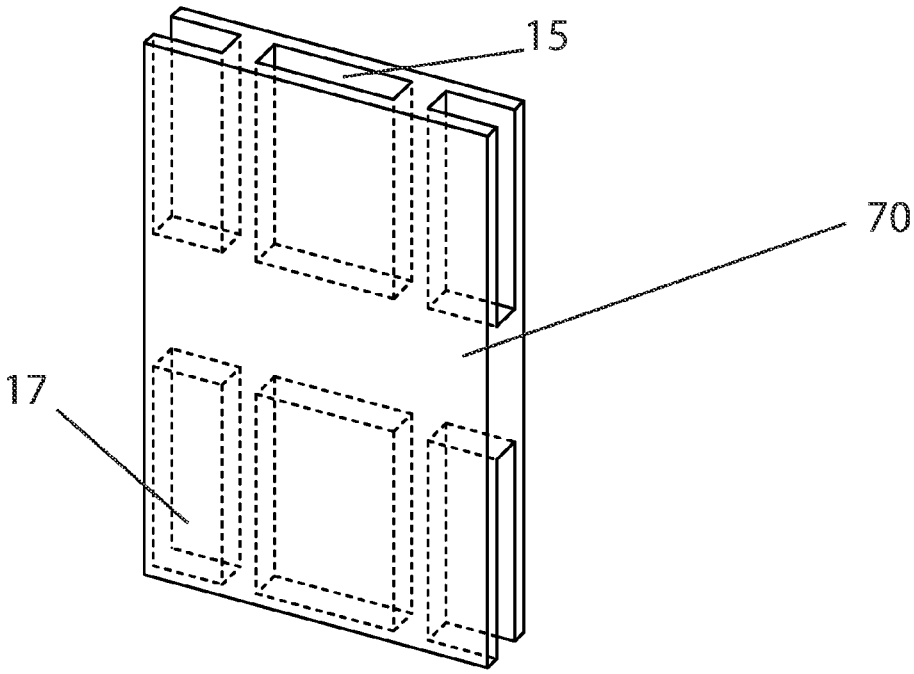
FIG. 3 is a perspective view of a wall part.
Figure 4:
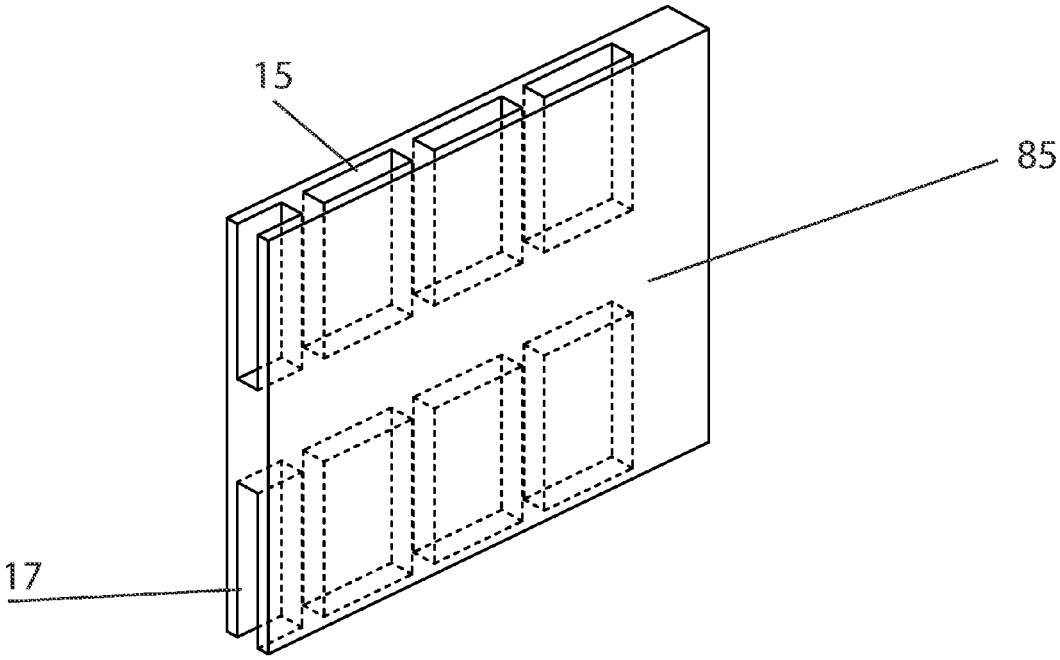
FIG. 4 is a perspective view of a wall part.
Figure 5:
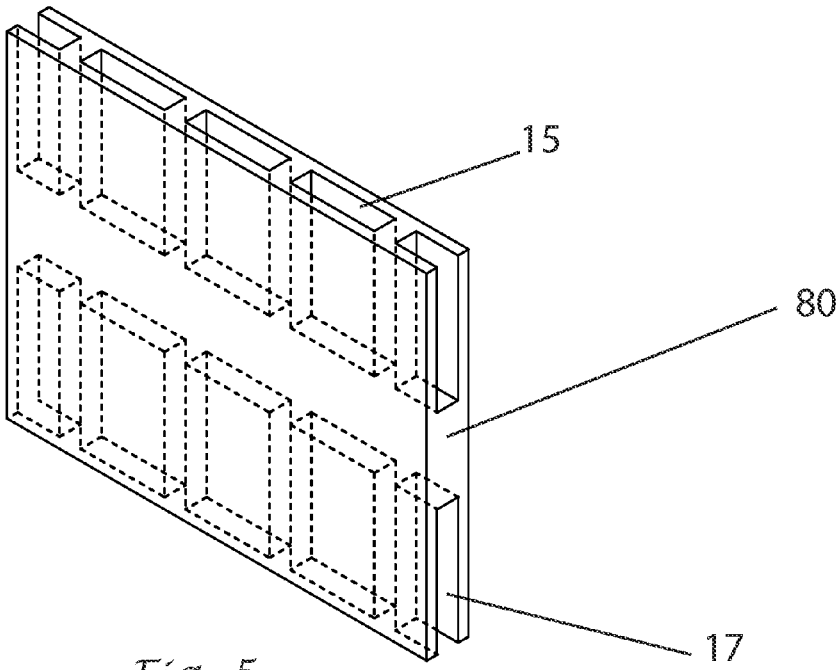
FIG. 5 is a perspective view of a wall part.

FIG. 2 shows Closed-Ended Small Wall 75, and FIG. 3 shows Small Wall 70. Both pieces have the same outer dimensions; the only difference between the two is that Closed-Ended Small Wall 75 does not have Corner cavities 17 on one side. FIG. 4 shows Closed-Ended Big Wall 85, and FIG. 5 shows Big Wall 80. The wall sections shown in FIGS. 4 and 5 are twice the length of the wall sections shown in FIG. 2 and FIG. 3, and thus have more Cavities 15. Stated differently, the Big Wall sections are equivalent to two small wall sections placed end to end. Further, the only difference between Closed-Ended Big Wall 85 and Big Wall 80 is that Closed-Ended Big Wall 85 does not have Corner cavities 17 on one side.

Referring now to FIG. 2 through FIG. 7 it is important to note the relationship between the corner pieces and the wall pieces. Dimensionally, Small Corner 50 is the equivalent of two Closed-Ended Small Wall 75*s* intersecting and fused together at the closed end at a ninety-degree angle as shown. Similarly, Big Corner 60 is dimensionally equivalent to two Closed-Ended Big Wall 85's intersecting and joined together at a ninety-degree angle. Stated differently, the length of the side walls of Big Corner 60 and the length of Big Wall 80 are equal, and the same is true for Small Corner 50 and Small Wall 70. Further, the matching corner pieces and wall pieces have the same number of Cavities 15.

Figure 6:
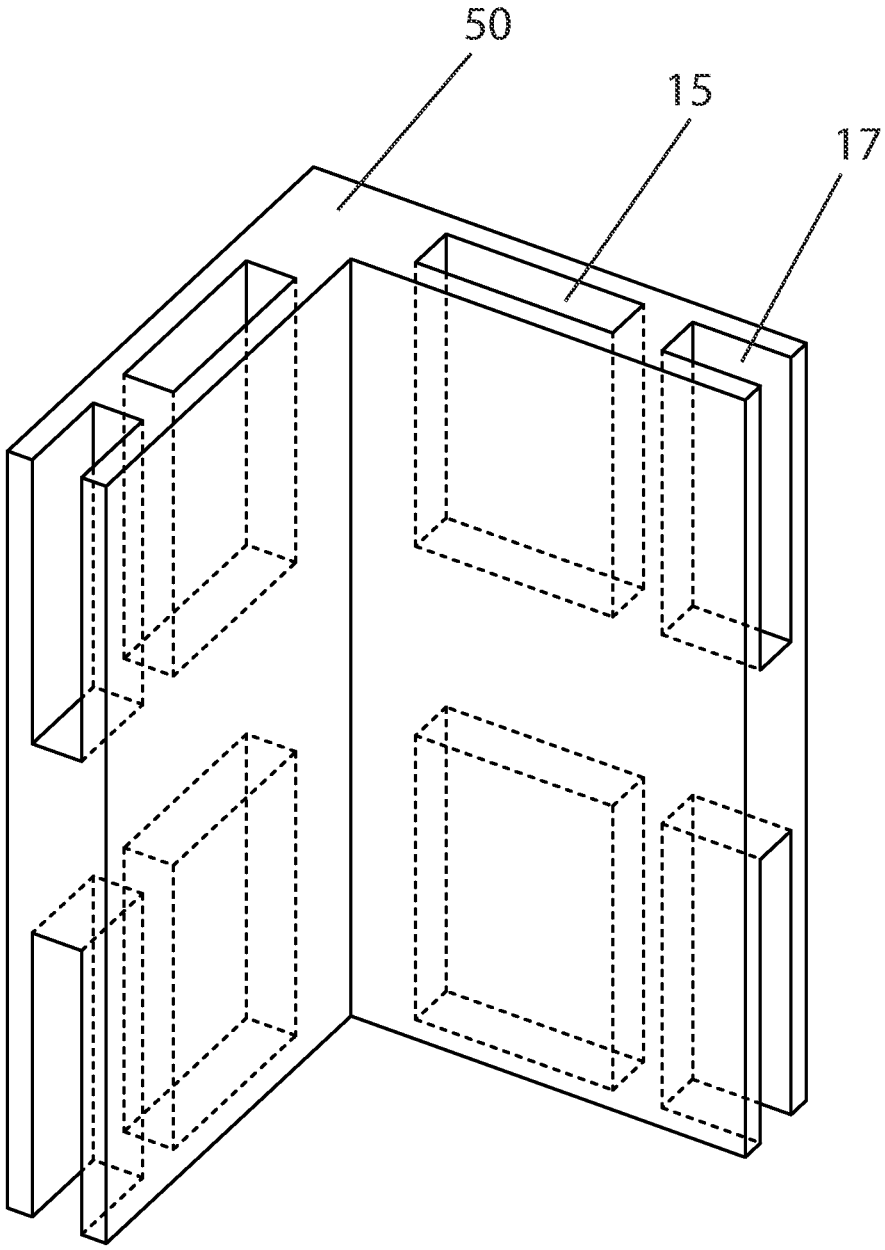
FIG. 6 is a perspective view of a corner part.

Referring now to FIG. 6, Small Corner 50 is shown. Small Corner 50 is a symmetrical, ninety-degree corner piece. Small Corner 50 is equivalent to two Closed-Ended Small Wall 75 sections that are joined at the closed side at a ninety-degree angle. The top half and bottom half sections of said wall sections are mirror images of each other. Thus, like the wall sections, Small Corner 50 is symmetrical about a middle line that is halfway up the height of Small Corner 50, and Small Corner 50 is symmetrical about the ninety degree corner angle.

Figure 7:
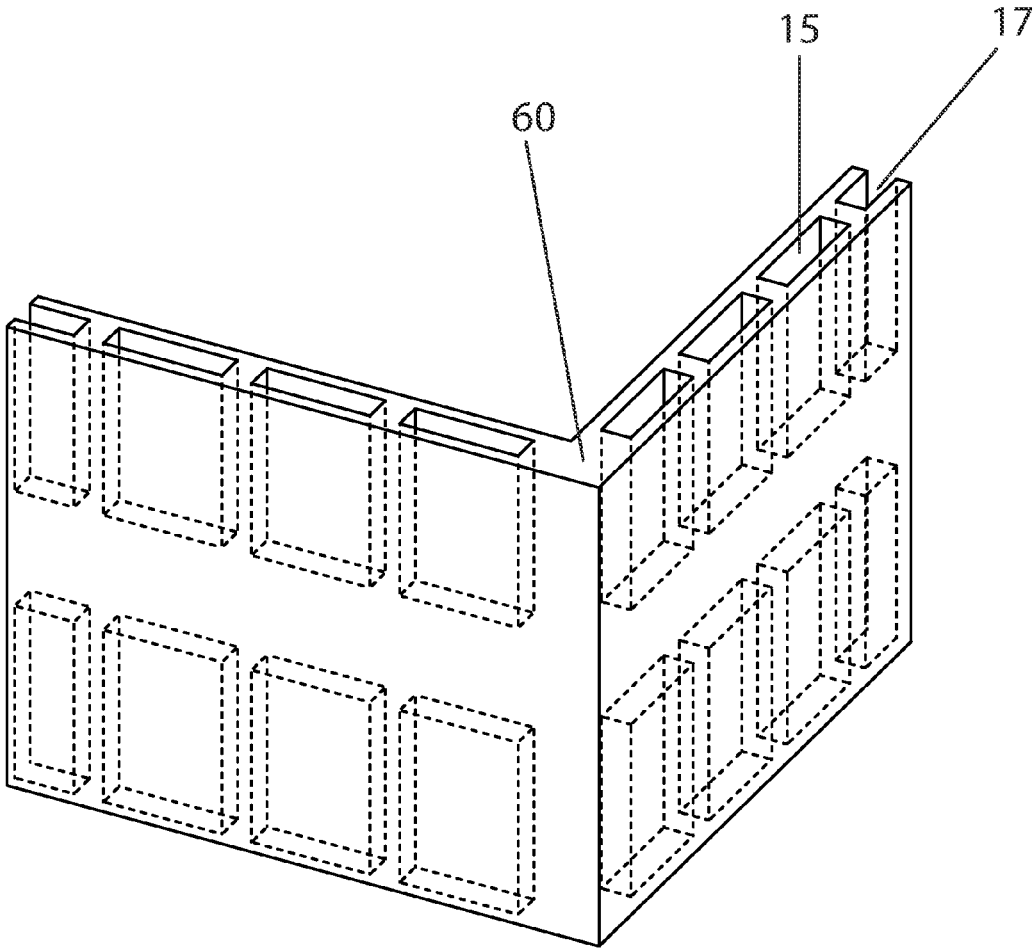
FIG. 7 is a perspective view of a corner part.

Referring now to FIG. 7, Big Corner 60 is shown. Big Corner 60 has all of the properties of Small Corner 50, except that Big Corner 60 wall sections are is twice as long with more Cavities 15. Further, FIG. 3 shows that the spaces between Cavities 15 are equal just like Small Corner 50 and the wall sections.

Figure 8:
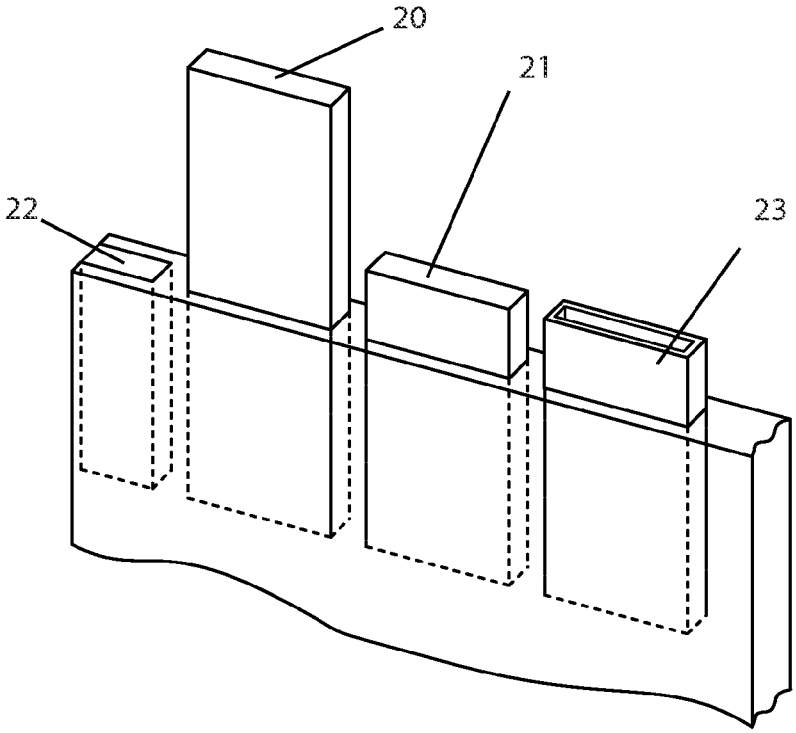
FIG. 8 is a perspective view of a section of a wall part and a connector.

Referring now to FIG. 8, four connectors are shown. Connector 20 is the primary connector used to build a structure. Connector 20 is shaped to fit snugly inside two Cavity 15*s* when said cavities have their openings lined up. The fit of the connector inside the cavity is a tight one, thus, Connector 20's cross section has approximately the same dimensions as the cross section of Cavity 15. Further, Connector 20 may not have completely straight sides along its length, rather the sides may have a slight curve to allow for easier insertion and a gradual press fit connection as the connector is pressed into the cavity. In other words, the cross section of Connector 20 may vary.

Connector 20 is used to connect wall pieces and corner pieces by placing Connector 20 inside Cavities 15 and Cavities 17. Short Connector 21 is shorter than Connector 20, and is used when a wall piece or corner piece is connected to something other than another wall piece or corner piece, such as a floor or roof section. Fill Connector 22 is used to fill Cavities 17 when needed or as desired, further, 2 Fill Connector 22*s* can be used to fill one Cavity 15. Hollow connector 23 is shown as another embodiment of a type of connector that can be used.

Figure 9:
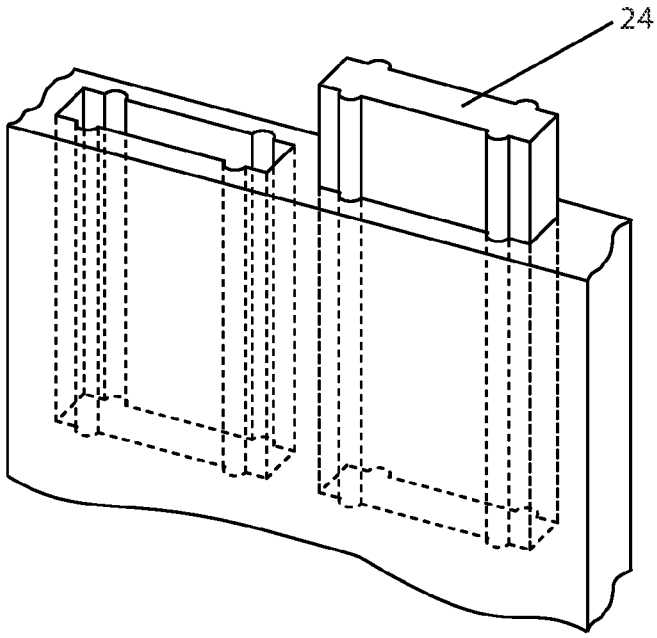
FIG. 9 is a perspective view of a section of a wall part and a connector.
Figure 10:
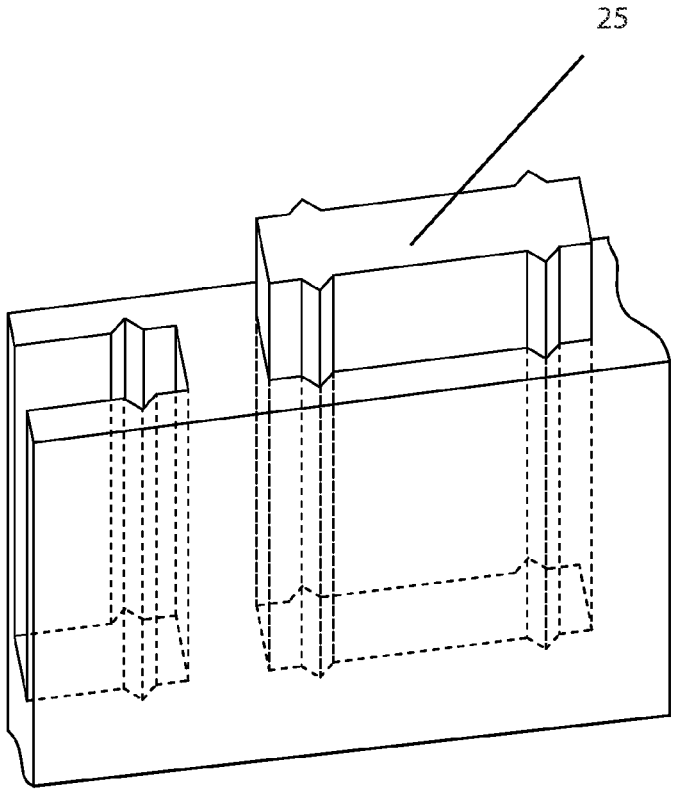
FIG. 10 is a perspective view of a section of a wall part and a connector.

Referring now to FIG. 9 and FIG. 10, connectors with ridges are shown. Rounded Ridge Connector 24 and Triangle Ridge Connector 25 are embodiments shown to demonstrate configurations where the connectors and cavities can have specific slot-and-tab shapes that match up with each other.

Figure 11:
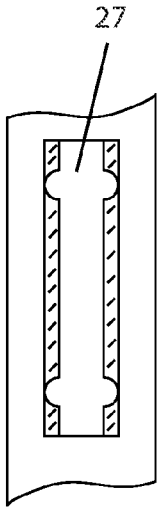
FIG. 11 is a cross section of a wall part and a connector.
Figure 12:
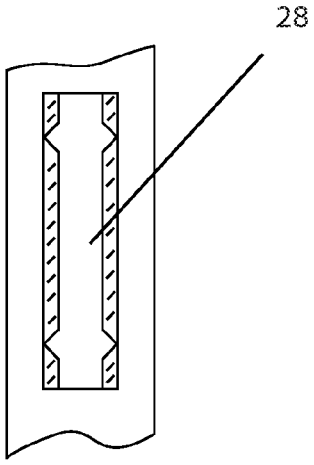
FIG. 12 is a cross section of a wall part and a connector.

Referring now to FIG. 11 and FIG. 12, a top view of a connector embodiment is shown. Rounded Ridge Slim Connector 27 and Triangle Slim Connector 28 are generally smaller than the previously discussed connectors. In this embodiment, ridges are used as the primary contact surface on the connector. With this embodiment a tighter press-fit configuration is possible due to the contact surface area being reduced as compared to the previously discussed connector configurations.

Figure 13:
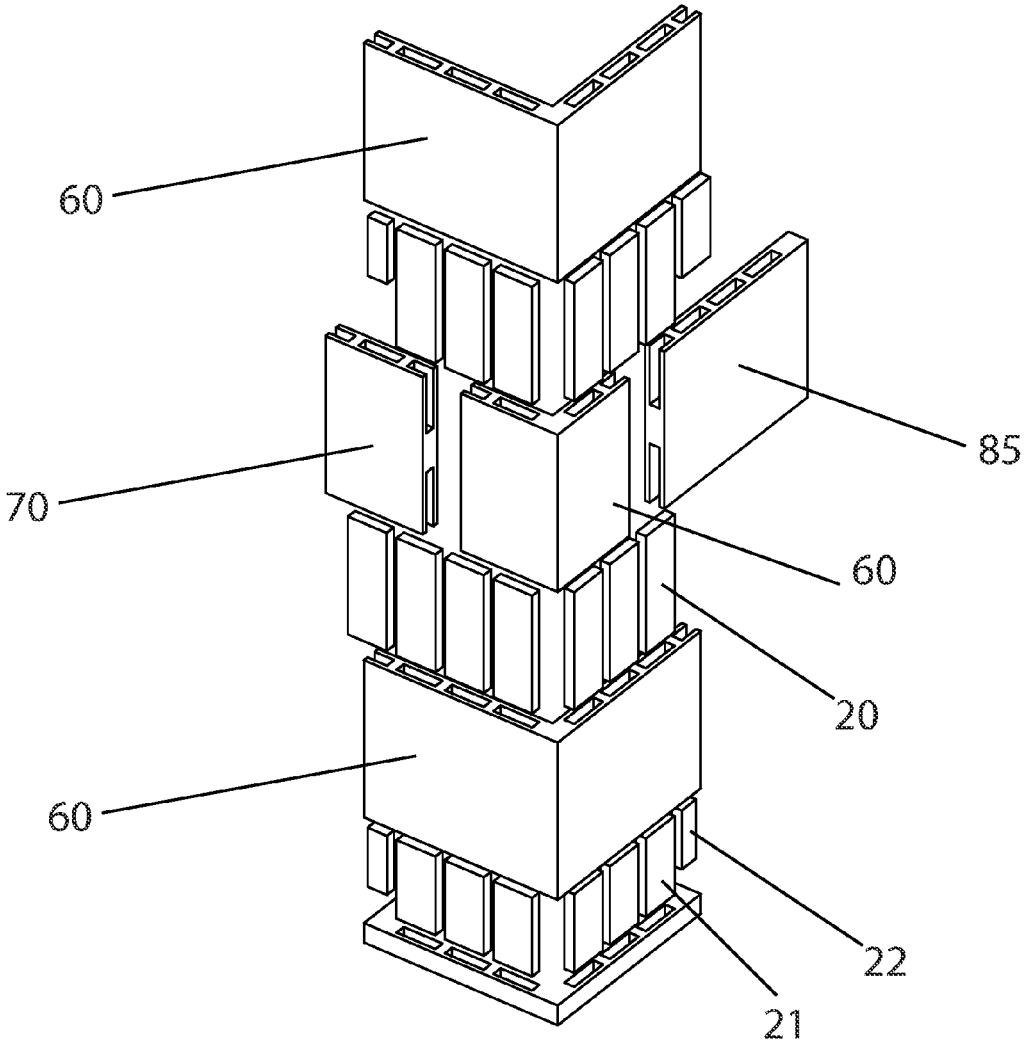
FIG. 13 is an exploded perspective view of a section of an assembly.

Referring now to FIG. 13, an exploded view of a constructed corner is shown. The purpose of FIG. 13 is to demonstrate the relationships between the wall, corner and connector pieces when said pieces are used to construct a building.

Figure 14:
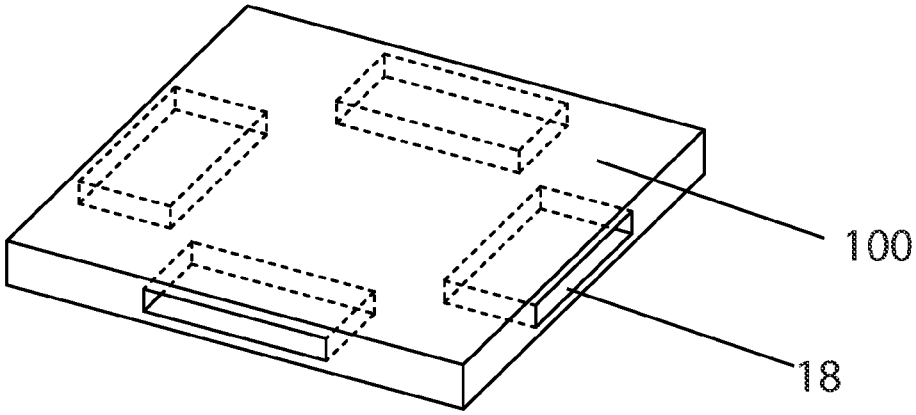
FIG. 14 is a perspective view of a floor part.
Figure 15:
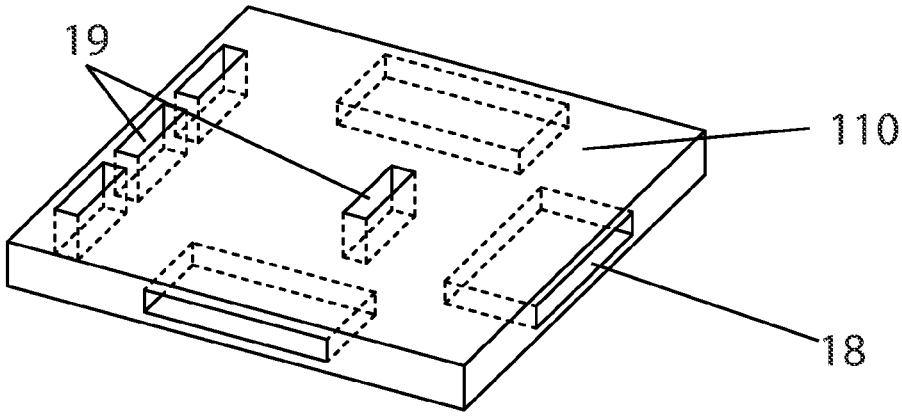
FIG. 15 is a perspective view of a floor part.
Figure 16:
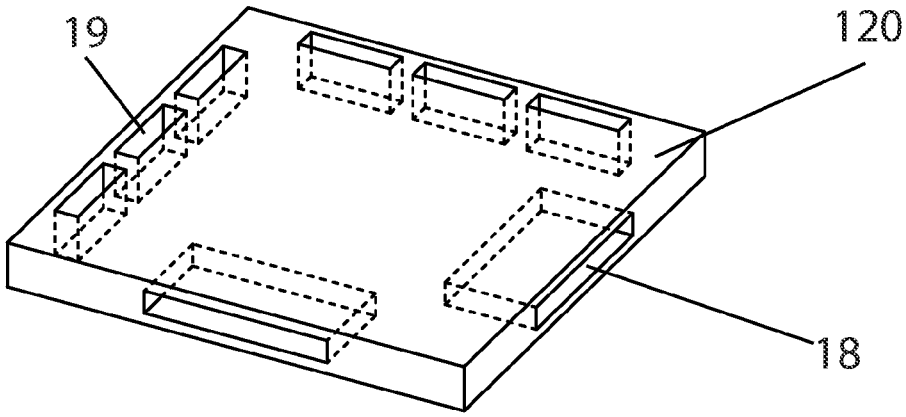
FIG. 16 is a perspective view of a floor part.

Referring now to FIG. 14, FIG. 15 and FIG. 16, three floor pieces are shown. All three floor pieces are squares with a side length equal to the length of Big Wall 80. FIG. 14 shows Center Floor 100, with Double Cavities 18 centered on each side surface. Double Cavities 18 have twice the length of Cavities 15, and fit two Connector 20*s* side by side. FIG. 15 shows Side Floor 110 that has Double Cavities 18 centered on three sides, and Short Cavities 19 along the edge of the side that does not have a Double Cavity 18. Short Vertical Cavities 19 have a cross section that is the same as the opening used to create Cavity 15, but the depth of Short Vertical Cavity 19 is less than the depth of Cavity 15. Short Vertical Cavity 19, Cavity 15, and Short Connector 21 are used to connect wall, corner and floor pieces. Thus the length of Short Connector 21 is equal or slightly less than the combined depths of Short Vertical Cavity 19 and Cavity 15. Short Vertical Cavities 19 are positioned on the edges of Side Floor 110 to line up with Cavities 15 of Big Wall 80. Also identified in FIG. 15 is a Short Vertical Cavity 19 that is not positioned on the edge that can be used for additional building configurations. Referring now to FIG. 16, Corner Floor 120 is shown. Corner Floor 120 has Double Cavities 18 on two adjacent sides and Short Vertical Cavities 19 on the other two sides as shown.

Figure 17:
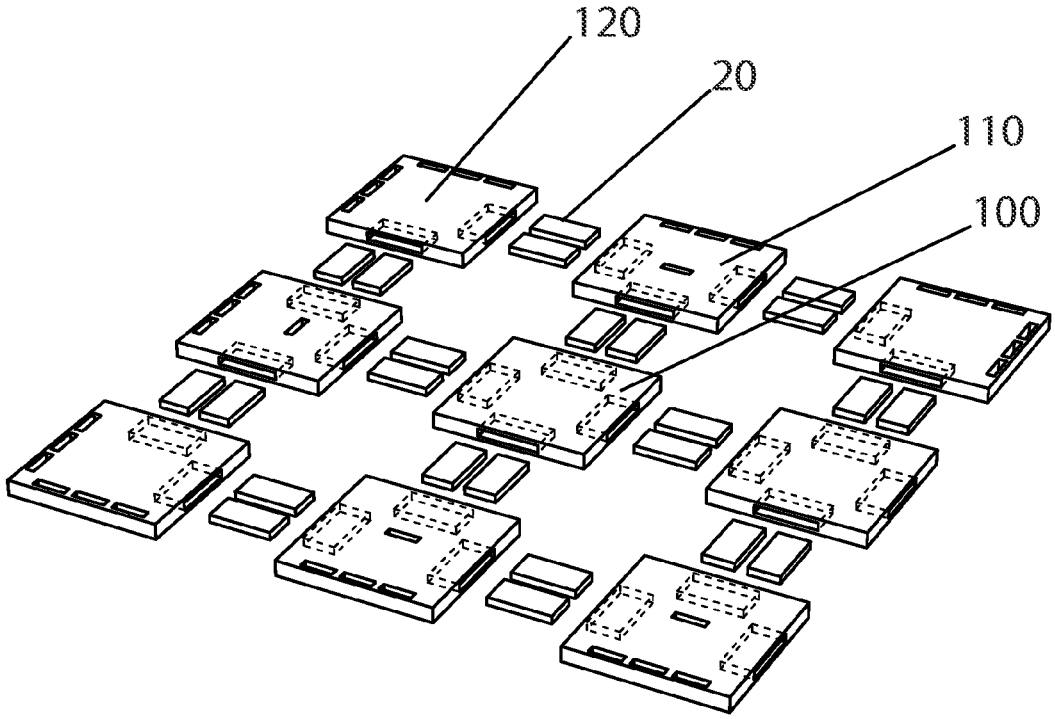
FIG. 17 is perspective view of an exploded assembly of a floor.

Referring now to FIG. 17, an exploded assembly is shown to illustrate one embodiment of a floor assembly.

Figure 18:
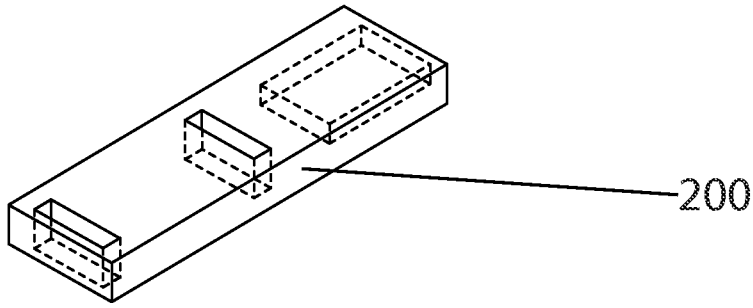
FIG. 18 is a perspective view of a roof support part.
Figure 19:
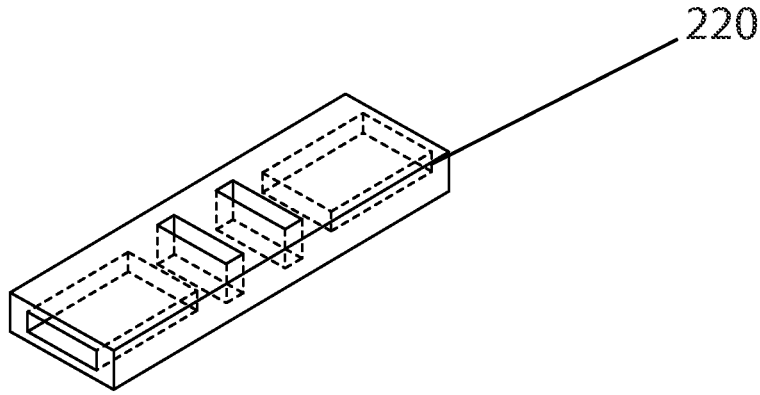
FIG. 19 is a perspective view of a roof support part.
Figure 20:
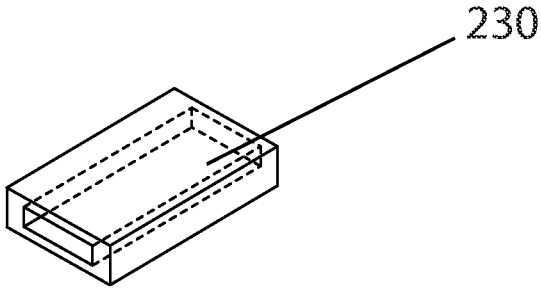
FIG. 20 is a perspective view of a roof support part.

FIGS. 18 through 20 show roof support elements. Generally, the roof support elements and connectors are used to create a beam that extends from the top of one wall to the top of the wall opposite to it. FIG. 18 shows Roof Support End 200 that connects to the top of a corner or wall piece using Short Connector 21 and a vertical cavity that extends from the top surface through the bottom surface. An additional vertical cavity is shown that can be used for differently sized building, or to create an overhang. A horizontal cavity is shown that is equivalent to Cavity 15 on the end Roof Support End 200 that is used to connect the piece to another piece using Connector 20. FIG. 19 shows Roof Support Long Extension 220 that has vertical cavities in the center and horizontal cavities at both ends. FIG. 20 shows Roof Support Short Extension 230 that has a single horizontal cavity extending from end to end.

Figure 21:
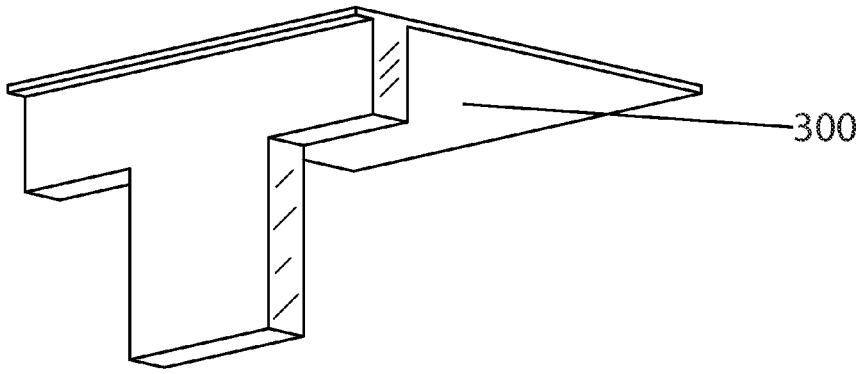
FIG. 21 is a perspective view of a roof part.
Figure 22:
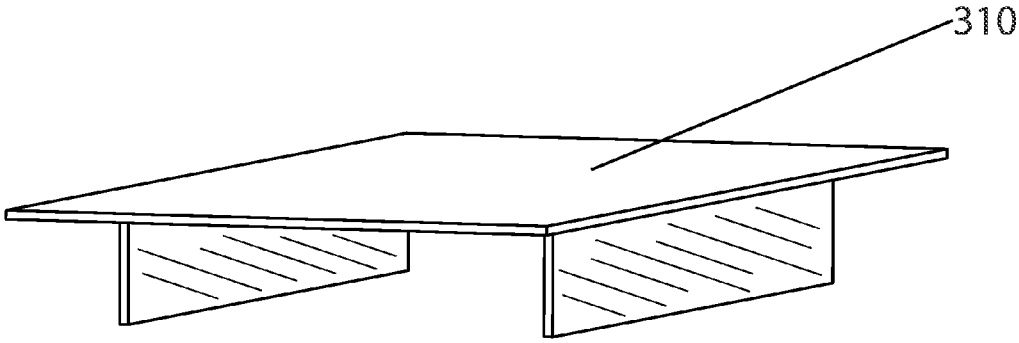
FIG. 22 is a perspective view of a roof part.
Figure 23:
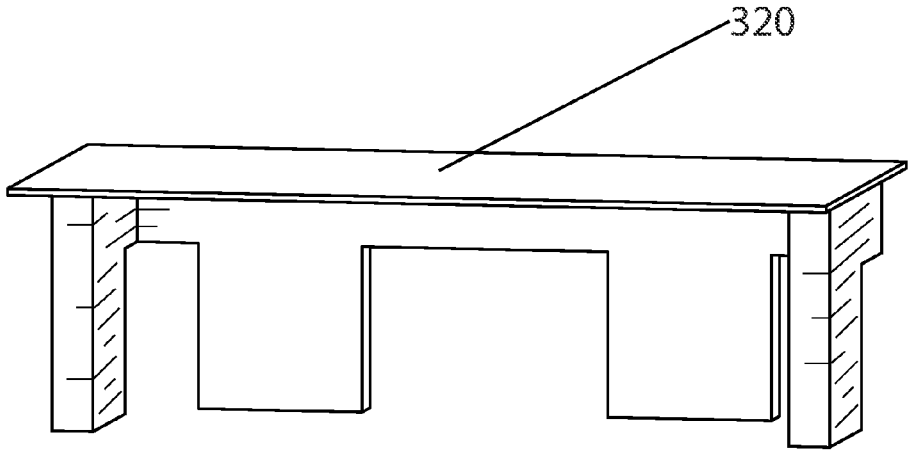
FIG. 23 is a perspective view of a roof part.
Figure 24:
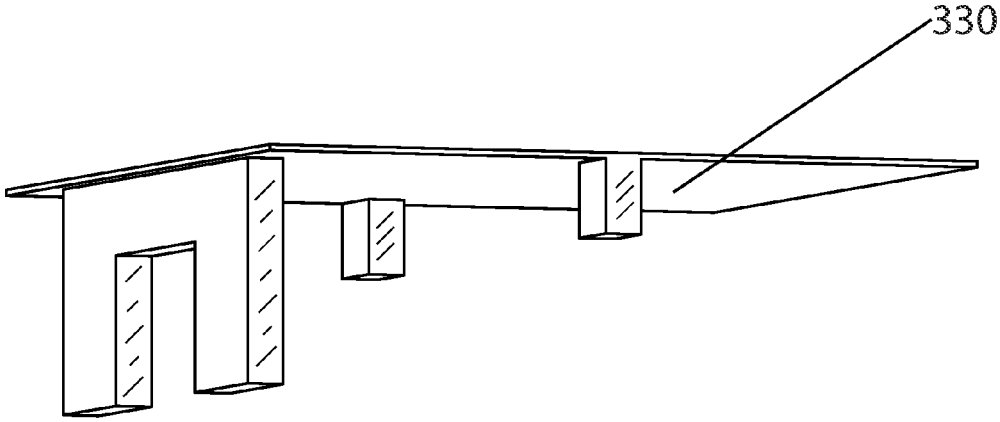
FIG. 24 is a perspective view of a roof part.

FIGS. 21 through 24 show roof elements. Generally, the roof element have a flat surface and extensions that extend from the flat surface that fit into the cavities on the top of the wall sections, corner sections and roof support elements. FIG. 21 shows Narrow Roof End 300 that has a flat section on top that creates a section of roof, and from that roof section extends a section that has the same cross-sectional dimensions as the connectors so that the piece can be placed into a Cavity 15 or two Cavity 17*s*. FIG. 22 shows Roof Center 310 that is used when a wall or corner cavity is not available. Roof Corner 320 is shown in FIG. 23 that has features for use over corner pieces. Said features include extensions that fit into Cavities 15 or 17 are arranged at 90 degrees with respect each other. FIG. 24 shows Wide Roof End 330 that has two extensions for Cavities 15 or 17 and smaller extensions that fit into the vertical cavities of the roof extensions.

Figure 25A:
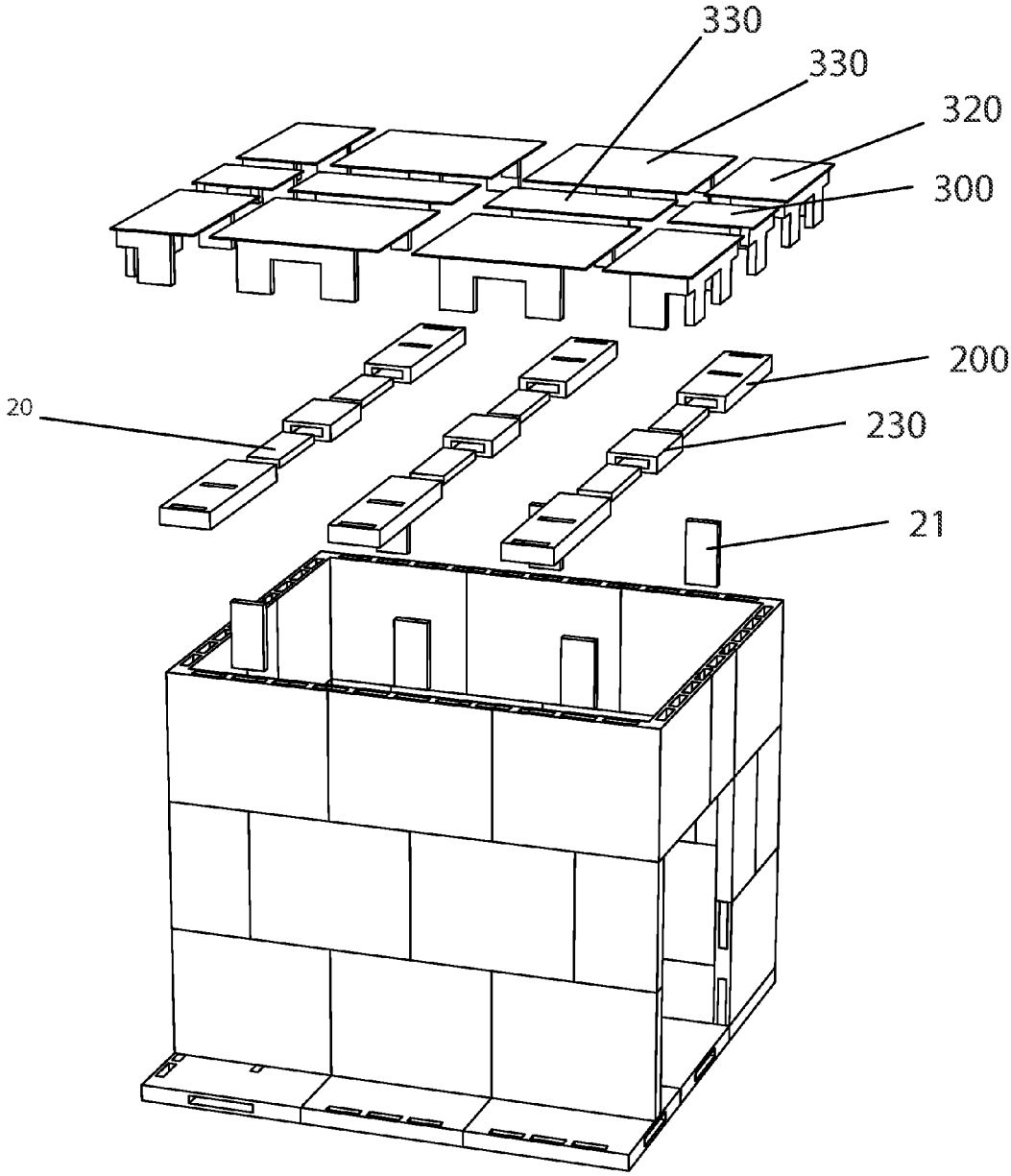
FIG. 25*a* is an exploded perspective view of a roof assembly.
Figure 25B:
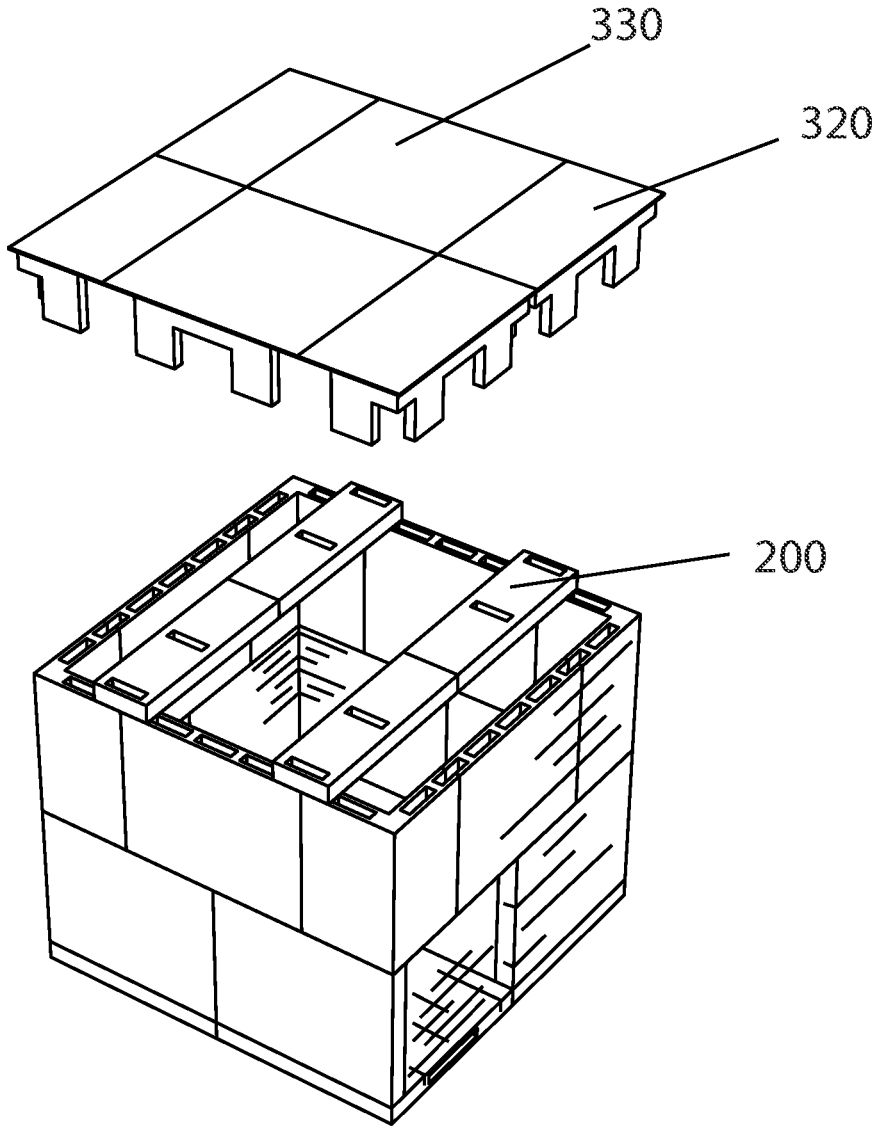
FIG. 25*b* is an exploded view of a partially installed roof assembly.

FIG. 25 shows an exploded assembly view of a possible configuration for a roof assembly. The roof support elements and connectors create beams that extend from wall to wall and are attached to said walls with connectors. The roof elements are placed to that one continuous surface exists over the area bounded by the walls and corner sections.

Figure 26:
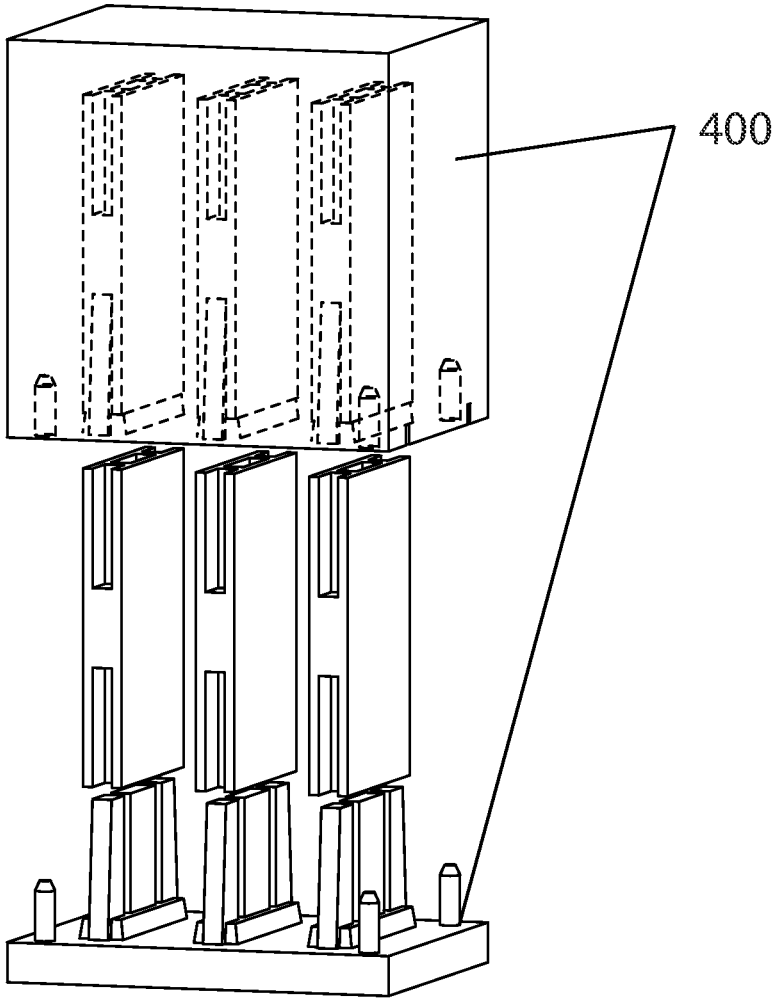
FIG. 26 is a perspective view of a mold; and,
FIG. 27 is a perspective view of a shipping and storage assembly.

In the preferred embodiment, the parts shown in the preceding figures are made of plastic. Further, the preferred manufacturing process for said parts is plastic-injection molding. FIG. 26 shows Plastic Injection Mold 400 that is a possible configuration of a device that can be used to create a short wall section.

Figure 27:
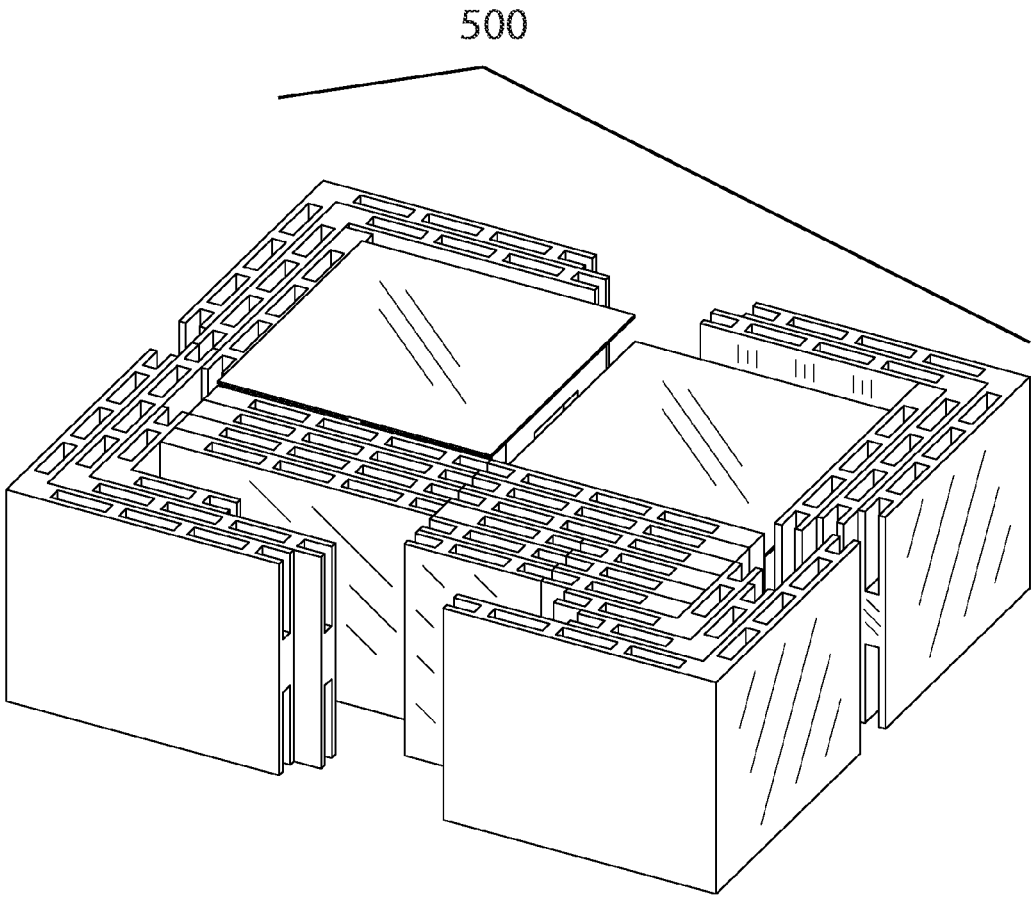

Referring now to FIG. 27, a possible shipping and storage configuration is shown. One of the advantages of the invention is that it can be stored and shipped easily. In the preferred embodiment a box-like shipping container is not needed, rather the structural components create a shipping container that can be wrapped and shipped. Further, if the intended structure is approximately 2½ feet tall, as would be ideal for a doghouse, the shipping item would only be 8 inches tall, and less than 3 feet wide.

The advantages of the present invention include, without limitation, a construction kit for a small structure that is made of a small number of pieces. The structures that can be created using the kit are ideal for pets or small children. Assembling the structures and taking it apart is fun and easy, so the kit can be used as an amusement device. Further, floor and roof options create a structure that can house an animal outdoors and provide shelter from the elements. In the preferred embodiment the pieces are made of plastic, thus the structure is inexpensive, and easy to clean. The pieces can fit together during storage and shipping to that the footprint of the storage or shipping item is small in relation to the structure that can be built, and because the preferred embodiment is made of plastic, the shipping is inexpensive relative to other heavier materials.

In broad embodiment, the present invention is construction kit for a small structure.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

I claim:

1. A kit for creating a small structure having prefabricated structural parts that fit together using a common connector comprising:

wall sections, having a front surface and a back surface, said surfaces having four right angle corners and being dimensionally equivalent to each other and having a height and a length, said wall sections having four side surfaces, including a top surface, a bottom surface, a left surface and a right surface, said side surfaces having four right angle corners, and each side surface having equivalent dimensions to the side surface opposite to it;

first wall sections having at least one top cavity on said top surface, said first cavity having a depth, said first wall sections having at least one bottom cavity on said bottom surface, said bottom cavity being dimensionally equivalent to said top cavity and positioned opposite of said top cavity such that said top and bottom surfaces are dimensionally equivalent;

said first wall sections having at least two corner cavities on at least one of said right or left surface, said corner cavities having a continuous opening on the corners shared by said left or right side surface and the top and bottom surfaces, said corner cavity being sized such that two said first wall sections positioned with corner cavities aligned and facing each other create a cavity equivalent to said top and bottom cavities;

corner sections, including a first corner section and a second corner section; said first corner section being equivalent to two of said first wall sections intersecting and joined together to create a right-angle corner having two walls with top and bottom cavities, each wall having a length equal to the length of said first wall section;

said first corner section's walls having cavities that are equivalent to each of said first wall section's cavities in size and position;

said second corner sections being equivalent to said first corner sections except that said second corner section's walls having a length half that of said first corner section's walls;

said corner sections having four of said corner cavities on outside corners formed by the walls of the of the corner sections;

connector pieces having a cross section with the same shape of said openings and having a length equal to double the depth of said cavities.

2. A kit for creating a small structure as claimed in claim 1, further comprising:

second wall sections being equivalent to said first wall section cut in half from the top surface to the bottom surface, such that said second wall section has a length that is half of said first wall section;

said second wall section having at least two of said corner cavities on at least one of said second wall section's right or left side.

3. A kit for creating a small structure as claimed in claim 1, further comprising:

roof support sections, including an edge support section and a center support section, having top and bottom surfaces, said top and bottom roof support surfaces having equivalent rectangular shapes, said roof support sections having four side surfaces, each side surface having equivalent dimensions to the side surface opposite to it and having two long side surfaces and two short side surfaces;

at least two of said roof support sections being edge support sections having at least one vertical cavity on at least one of said top or bottom roof support surfaces;

said vertical cavity having an opening equivalent to the openings of said wall section's top and bottom cavities;

said edge support sections having a cavity on said short side surface equivalent to said wall section's top and bottom cavity, said center support sections having at least one cavity with openings on both of said short side surfaces being equivalent to the openings of said wall section's top and bottom cavities, and short connector pieces sized to fit snugly in said vertical cavity and said top or bottom cavities, and sized to fill the empty space created when the openings of said cavities are aligned.

4. A kit for creating a small structure as claimed in claim 1, further comprising:

floor sections, having top and bottom surfaces having four corners and equivalent dimensions;

said floor sections having four side surfaces having four corners, and each side surface having equivalent dimensions to the side surface opposite to it;

a plurality of vertical cavities on said top floor surface with openings equivalent to the openings of said wall section's top and bottom cavities and positioned to line up with the cavities of said first corner section;

at least two horizontal cavities equivalent to said wall and corner section's top and bottom cavities, said horizontal cavities being on at least two of said floor section's side surfaces; and, short connector pieces sized to fit snugly in said vertical cavity and said top or bottom cavities, and sized to fill the empty space created when the openings of said cavities are aligned.

5. A kit for creating small structures as claimed in claim 1, wherein all sections are made of plastic; said first wall section's front surface has an area no greater than one square foot; and said top surface has an area of less than ½ of a square foot.

6. A kit for creating small structures as claimed in claim 1, wherein said cavities have a generally rectangular shape, and said connector pieces have shaped ridges extending along the length of said connector.

7. A kit for creating small structures as claimed in claim 1, wherein said cavities include shaped slots placed symmetrically around the perimeter of the cavities and extending from the top to the bottom of said cavities.

8. A kit for creating a small structure as claimed in claim 1, further comprising:

at least one roof section, having a top section and extensions protruding outwardly from one side of said top section, said extensions sized to fit snugly in said top and bottom cavities.

9. A kit for creating a small structure as claimed in claim 1, further comprising:

at least one floor section having a top and bottom surface and four side surfaces, each surface having equivalent dimensions to the surface opposite to it;

a plurality of vertical cavities on said top floor surface with openings positioned to line up with said wall and corner section's bottom or top openings;

short connector pieces sized to fit snugly in said vertical cavities and said wall or corner section's top or bottom cavities, and fill the empty space created when the openings of said cavities are aligned;

at least one roof section, having a top section and extensions protruding outwardly from one side of said top section, said extensions sized to fit snugly in said top and bottom cavities.

10. A kit for creating small structures as claimed in claim 9, wherein all sections are made of plastic.

11. A kit for creating small structures as claimed in claim 9, wherein all cavities have a generally rectangular shape and further include shaped slots placed symmetrically around the perimeter of the openings and extending from the top and bottom surfaces of said wall sections to the bottom of said cavities.

12. A small structure made of prefabricated parts comprising:

wall sections, having six surfaces including front, back, top and bottom surfaces, said front and back surfaces being the larger of said surfaces and having a square or rectangular shape having a height and length, said top and bottom surfaces having a rectangular shape giving the wall section a depth;

a plurality of female connections evenly spaced on said wall section's top, bottom, and corner surfaces such that a female connection is bisected at each corner of said wall section, said bisection resulting in a corner female connection with a continuous opening shared by the two surfaces that make up the corner, and wherein the corner female connection is sized such that two wall sections positioned with corner female connections aligned and facing each other create a female connection equivalent to the female connections on the top and bottom surface of the wall section;

corner wall sections being equivalent to two of said wall sections intersecting and joined to create a right-angle corner wall section; said corner wall sections having four female corner connections on its outside corners and are equivalent to the wall section's corner female connection;

half corner wall sections being equivalent to said corner wall section except that the length of said half corner wall section's walls are half that of said corner wall section's walls;

a plurality of connectors having a size to fit snugly inside and fill two of said female openings aligned and facing each other; and, all sections being made of plastic.

13. The small structure of claim 12, further comprising:

at least four floor sections, said floor sections having a plurality of short female connections on the top surface, said plurality of female connections including at least one group of connections positioned to match up with said corner wall section's female connections;

a plurality of short connectors sized to fill the empty space created when said short female connections and said wall or corner section's female connections are aligned.

14. The small structure of claim 12 further comprising:

at least one roof element, having a top section and extensions protruding outwardly from one side of said top section, said extensions sized to fit snugly in some or all of said female connections.

15. The small structure of claim 14, further comprising:

rectangular roof support sections, including an edge support section and a center support section, having top and bottom surfaces two long side surfaces and two short side surfaces;

said edge support sections having a vertical female connection on the top or bottom surface that can accept said connectors, said edge support sections further having at least one female connection on said short side surface equivalent to the female connections of said wall sections;

center support sections having female connections on both of said short side surfaces being equivalent to said wall section's female connections;

short connector pieces equivalent to said connectors except that short connector pieces are sized to fill the space created by placing the vertical female connection over the female connection.

16. The small structure of claim 15, wherein said wall section's height is less than 18 inches but greater than six inches, length is less than 20 inches but greater than six inches and a depth less than three inches but greater than one-half inch.

17. The small structure of claim 12, further comprising half wall sections having all of the properties of said wall sections except that the length of said half wall section is half that of said wall section.

18. The small structure of claim 17, further comprising fill-in connectors that are sized to fill in said corner female connection.

19. The small structure of claim 17, further comprising closed-ended wall sections having only two bisected female connections.

20. A small structure made of prefabricated plastic parts comprising:

a floor having the shape of a square or rectangle;

a first layer of structural components including at least three first corner sections each having two equivalent wall sections intersecting to create a right-angle corner, said corner sections positioned at three corners of said floor, and having a plurality of chambers equally spaced on the top and bottom surfaces including half-chambers on the edges of said top and bottom surfaces, said first layer further including at least one wall section being equivalent to the wall sections of said first corner sections, including having identical chambers and half-chambers, said at least one wall section positioned on one side of the corner of said floor that does not have one of said first corner sections;

said floor having a plurality of chambers on the top surface arranged to line up with the bottom chambers of said first layer's structural components;

connectors sized to fit tightly inside the lined-up chambers of said floor section and the bottom chambers of said first layer of structural components thereby connecting said floor section and said first layer of structural components;

at least one additional layer of structural components including four second corner sections having all of the properties of said first corner sections except that the length of said second corner's wall sections are half the length of said first corner section's wall sections, said second corner sections being positioned on top of said first corner sections such that the bottom chambers of said second corner section are aligned with the top chambers of said first layer, said additional layer further including at least four wall sections equivalent to said at least one wall section; said additional layer's wall sections positioned such that the half-chambers of said additional layer's wall sections are aligned with the half-chambers of said second corner section's half-chambers thereby creating a chamber equal to said chambers;

connectors sized to fit tightly inside the top chambers and aligned half-chambers of said first layer's structural components and the bottom chambers of said additional layer's structural components; said first layer's structural components and said additional layer's structural components being positioned such that all of the two aligned half-chambers of one layer share one of said connectors with a single chamber of the other layer;

a roof having a roof surface and extensions positioned and sized to fit tightly into top chambers of a layer of structural components.

* * * * *